US005405261A

United States Patent [19]

Scraggs et al.

[11] Patent Number: 5,405,261

[45] Date of Patent: Apr. 11, 1995

[54] WASTE OIL FIRED HEATER WITH IMPROVED TWO-STAGE COMBUSTION CHAMBER

[75] Inventors: Charles R. Scraggs, Alpharetta, Ga.; Thomas E. Silver, Henegar, Ala.

[73] Assignee: Free Heat, Inc., Henegar, Ala.

[21] Appl. No.: 990,417

[22] Filed: Dec. 15, 1992

[51] Int. Cl.[6] ..... F23M 9/06

[52] U.S. Cl. ..... 431/171; 431/350; 431/353; 126/350 R; 126/110 R; 122/17; 122/116

[58] Field of Search ..... 431/350, 347, 170, 7, 431/117, 118, 119, 171, 326, 328, 253, 352; 126/92 R, 92 AE, 92 C, 350 R, 116 R, 151, 110 R; 122/18, 17, 16, 45, 115; 239/122, 500

[56] References Cited

U.S. PATENT DOCUMENTS

| | | | |
|---|---|---|---|
| 1,015,314 | 1/1912 | Harrington | 126/350 R |
| 1,665,924 | 4/1928 | Hicks | 431/347 X |
| 1,700,353 | 1/1929 | Evans | 431/171 X |
| 1,919,285 | 7/1933 | Wetherbee | 126/92 C |
| 1,978,517 | 10/1934 | Wetherbee | 431/347 X |
| 2,098,383 | 11/1937 | Furlong | 431/170 X |
| 2,329,920 | 9/1943 | Loveley | 431/171 |
| 2,869,626 | 1/1959 | Sherman | 431/171 X |
| 3,734,677 | 1/1973 | Murase et al. | 431/88 |
| 3,816,055 | 6/1974 | Lear | 431/171 |
| 4,284,402 | 8/1981 | Sheets et al. | 431/9 |
| 4,504,215 | 4/1985 | Akiyama et al. | 431/10 |
| 4,842,509 | 9/1989 | Hasenack | 431/10 |

FOREIGN PATENT DOCUMENTS

| | | | |
|---|---|---|---|
| 0206549 | 12/1986 | European Pat. Off. | 126/92 R |
| 2523214 | 3/1976 | Germany . | |
| 731089 | 6/1955 | United Kingdom | 126/92 |

*Primary Examiner*—Carl D. Price
*Attorney, Agent, or Firm*—Jones & Askew

[57] ABSTRACT

An improved two-stage combustion chamber for burning waste hydrocarbons such as crank case oil, spent motor oil, transmission fluid, lubrication dopes, and heavy bodied gear lubes. The combustion chamber is formed from a plurality of spaced apart, stacked annular rings that form a flame containment housing having superheated surfaces. The flame containment housing contains the flame of an atomizing oil burner suitable for burning the variable viscosity waste hydrocarbons. The annular rings include outer walls and inwardly extending flanges that intercept unburned fuel droplets and combustion byproducts, vaporizing the droplets and/or stimulating secondary combustion. The annular rings are removable and replaceable, and are supported in spaced-apart relation by spacers on a plurality of support rods. Combustion byproducts and/or unburned fuel droplets are deflected by the flanges of the annular rings and vaporized or subjected to secondary combustion, thereby minimizing condensation on the relatively cool surfaces of a heat exchanger positioned close to the combustion chamber. The combustion chamber is thus useful in a heat transfer apparatus for heating water or air with waste hydrocarbons.

39 Claims, 3 Drawing Sheets

WASTE OIL FIRED HEATER WITH IMPROVED TWO-STAGE COMBUSTION CHAMBER

TECHNICAL FIELD

The present invention relates generally to waste oil burners, and more particularly relates to an improved two-stage combustion chamber that utilizes waste hydrocarbons such as crank case oil, spent motor oil, transmission fluid, lubrication dopes, and heavy bodied gear lubes, in order to heat water or air while minimizing waste hydrocarbon condensation.

BACKGROUND OF THE INVENTION

Hydrocarbons have traditionally been widely used as an energy source due to their relatively low cost in comparison with other types of fuels or electricity. However, waste hydrocarbons such as crankcase oil, spent motor oil, transmission fluid, lubrication dopes and heavy body gear lubes, while generated in abundance during the operation of gas stations, truck stops, and vehicle repair shops, have not proven to be a useful source of energy and are generally discarded. Seemingly, such waste hydrocarbons could provide a valuable source of energy for purposes such as space and water heating if they could be used a fuel.

However, waste hydrocarbons have proven problematic as a fuel source. Conventional fuel oil burners apparently have difficulty gasifying all of the waste hydrocarbon because of varying viscosities of the waste oils and the presence of dirt and other contaminants. Attempts to burn waste oil in conventional fuel oil burners can result in various problems, including the accumulation of carbon (soot) in the fuel burner and the clogging of nozzles leading to the fuel burner.

The complete, both clean and smokeless, combustion of waste hydrocarbons has also proven to be difficult in conventional pressure atomizing burner systems. In the past, attempts have been made to use commercially produced atomizing burner units for burning waste hydrocarbons. Such atomizing burners force compressed air through a spray nozzle as a means for primary atomization of the fuel. However, widely varying viscosities of waste hydrocarbons make combustion unpredictable. For instance, waste hydrocarbons that have been gathered or stored in a common receptacle will invariably be comprised of mixtures of crankcase oil, spent motor oil, transmission fluid, lubrication dopes and heavy body gear lubes. The net effect of varying viscosities of these waste hydrocarbons in an atomizing burner is that the combustion pattern produces significant unburned droplets at the exterior of the combustion flame, and therefore smoke and air pollutants.

Also, if these unburned droplets impinge on cool surfaces, generally less than 600°–700° F., the waste hydrocarbons will not combust but will instead condense and accumulate, causing the combustion chamber to puddle with waste hydrocarbons, resulting in a messy and potentially hazardous situation. For example, it is possible for the accumulated droplets of unburned hydrocarbons to autoignite suddenly, resulting in flash fires or explosions.

Some atomizing liquid fuel burners have been designed with the object of completely burning the hydrocarbons in order to be more energy efficient, as well as avoid the undesired build-up of carbon and fuel droplets inside the combustion chamber. Many of these designs involve the use of two-stage combustion. In the liquid fuel burner described in U.S. Pat. No. 4,504,215 issued to Akiyarna., a thin coat of the fuel coats the inner wall of the fuel carburetor and flows to the rear end of the fuel carburetor, through scattering gaps, and onto the inner wall of a scattering ring. The thin, continuous coat of fuel is pulverized and atomized by the scatter ring. Primary combustion takes place in the combustion chamber, and secondary combustion occurs with a mixture of evaporated fuel and air.

While the two-stage combustion approach generally results in improved overall combustion, the design in the Akiyama patent still can suffer from accumulation of combustible byproducts and soot generation. It is known that combustion byproducts form in the flame and are transmitted downwardly of the combustion flame to cooler surfaces in the combustion chamber, where condensation and accumulation occurs. Some combustion byproducts are combustible and can cause the problems of unburned accumulations and autoignition.

In the liquid fuel burner described in U.S. Pat. No. 3,734,677 to Murase et al., a mixture of atomized liquid fuel and pre-heated air is burned on the surface of a heat-radiant cylinder and the resultant combustion gases are introduced into the interior of the radiant cylinder, where unburned gas is subjected to secondary combustion by contact with heated rods in the cylinder. While this approach recognizes the need for dealing with combustion byproducts, the heated rods are relatively thin, providing only a small surface area. If the heated surface area for causing secondary combustion were larger, it might be possible for greater secondary combustion to occur.

One approach to providing a greater surface area for secondary combustion of combustion byproducts is shown in German Patent No. 25 23 214 issued to Merk. This patent describes an oil burner with a fuel gasifier and atomizer that provides a fine fuel spray and gasifies the fuel with a concentric shell arrangement. The concentric shells comprise nested cylinders or collection plates arranged in the flame region.

While the Merk approach provides an improvement over the heated rod approach because of its greater heated surface area for secondary combustion and/or gasification, the concentric shell arrangement does not take into consideration the shape of a combustion flame. A combustion flame generally has an elongate tapered cylindrical shape; combustion byproducts are believed to form along the entire length of the flame. The concentric cylinders in the Dieter patent are relatively short compared to the length of the flame, with the possible result that combustion byproducts formed in the flame region subsequent to the concentric cylinders are not subjected to secondary combustion.

Accordingly, there is a need for a combustion chamber that, while capable of utilizing waste hydrocarbons, maximizes the efficiency of the produced heat while minimizing waste hydrocarbon condensation in said combustion chamber.

SUMMARY OF THE INVENTION

The present invention provides a unique and efficient two-stage combustion chamber that surrounds the combustion flame and minimizes problems from unburned waste hydrocarbon droplets produced from the primary combustion, by gasifying unburned droplets and/or causing secondary combustion. The improved combustion chamber is suitable for use as the heating element for a water heater or space heater, or for other heating purposes.

Briefly described, the present invention provides an improved two-stage combustion chamber having a replaceable flame containment housing. The improved combustion chamber comprises a housing defining a generally cylindrical shape. An oil burner is mounted in the housing to direct a flame in an axial direction of the cylindrical shape. A plurality of replaceable, spaced apart annular flame-containing rings define the flame containment housing. Each of the annular rings comprises an outer wall and an annular inner flange, with the rings being generally coaxial with the flame produced by the oil burner. The outer walls of the annular rings define the outer boundaries of the generally cylindrical shape, while the annular inner flanges of the annular rings define inwardly extending surfaces for vaporization and/or secondary combustion of scattered oil droplets from the oil burner and combustion byproducts. Means are provided for supporting the annular flame-containing rings in spaced apart relation.

More particularly described, the ring supporting means comprises a plurality of spaced apart elongate support rods positioned generally parallel to the axis of the flame of the oil burner, with the support rods extending along and defining outer boundaries of the generally cylindrical shape. The annular rings are confined between the support rods. A plurality of spacers are slidably positionable over the support rods and support the annular rings in spaced apart relation between adjacent ones of the annular rings. Preferably, the spacers are annular dough-nut shaped. The spacers hold the annular rings spaced apart a predetermined distance, defining openings in the cylindrical surface between annular rings through which spent exhaust gases escape.

Preferably, the annular rings are arranged so that the outer walls of the annular rings extend in the direction of the oil burner, and the inner flanges shield the openings between annular tings. This arrangement blocks or shields the openings between rings, and intercept any unburned fuel droplets that emit from the oil burner, or any combustion byproducts that are thrown off the flame.

The preferred ring spacers are also removable and replaceable, and are of a diameter and thickness sufficient to support the weight of a plurality of annular rings in a stacked configuration. Each of the annular rings is supported on each of the rods by one of the spacers. Thus, the flame containment housing comprises a stack of alternating annular rings and spacers.

Yet still more particularly described, the preferred oil burner comprises a rotary atomizing oil burner for dispersing oil-based fuel over a wide range of viscosities. Use of such an oil burner allows burning of various waste hydrocarbons such as spent motor oil, transmission fluid, lubrication dopes, gear lubes, and the like. Preferably, an air blower is employed for introducing air into the combustion chamber, through the atomizing oil burner.

The improved two-stage combustion chamber is useful as the heat source for a heat transfer apparatus, such as a water heater or a space heater. The present invention will therefore find utility at truck stops and service stations that generate quantities of waste hydrocarbons, especially those in colder climes needing auxiliary heat sources and/or those having vehicle washes.

A heat transfer apparatus according to the present invention comprises a combustion chamber, having a closed end, comprising a cylinder made of metal or other suitable material. An oil burner is mounted to the combustion chamber opposite the closed end for directing a flame inwardly of the combustion chamber. An air blower is provided for introducing air into the combustion chamber. A plurality of spaced apart annular rings is positioned between the oil burner and the closed end, the interior of the annular rings defining the interior of the combustion chamber. Means are provided for supporting the annular rings and the closed end in spaced apart relation. Finally, a heat exchanger is positioned around the combustion chamber for removing heat generated within the combustion chamber.

The preferred supporting means comprises a plurality of elongate rods defining an outer boundary of the cylinder of the combustion chamber, and a plurality of spacers, slidably positionable on the rods, for supporting the annular rings. Thus, the annular rings and spacers are conveniently removable and replaceable.

In applications where the invention is employed as a water heater, the heat exchanger preferably comprises a plurality of spiral water coils positioned about the combustion chamber. The heated exhaust gases pass outwardly through the spaces between the annular tings and into a space between the combustion chamber and the water coils, where the coils remove heat from the gases. The exhaust gases then are vented upwardly toward an exhaust flue, and may pass over additional water coils comprising the heat exchanger.

In applications where the invention is employed as a furnace or space heater, the heat transfer apparatus preferably comprises a plenum in which the combustion chamber is mounted for operation, and an air blower for moving air to be heated along an air path through the heat exchanger. A plurality of exhaust pipes is provided, extending from the plenum through the air path and into an exhaust flue, where exhaust gases from the combustion processes are vented and exhausted.

In either a water heater or air heater application, the operation of the annular rings to intercept any unburned oil droplets emitted from the atomizing oil burner, and provide a superheated surface for generating vaporization of unburned oil droplets and/or secondary combustion of combustion byproducts, substantially "scrubs" and cleans the exhaust gases and causes more complete combustion of the fuel. Use of the improved combustion chamber provides increased efficiency in combustion and minimizes the accumulation of unburned oil droplets and other undesirably combustion byproducts. The end result is greater burning efficiency as well as cleaner burning, lower noxious emissions, reduced particulate matter, and minimized accumulation (puddling) of unburned oil.

Unlike rods, pens, or other devices in the flame pattern, the L-shaped annular rings surround the flame, effectively entrapping stray droplets that could cause incomplete combustion and "smoking". The unique design of the present invention, and principally due to the "L-shaped" annular rings, provides the ability to redirect the flame into a regenerative burning pattern that provides for more efficient and complete burning of hydrocarbons, and further provides the ability to minimize hydrocarbon droplet condensation by containing the flame within the hot combustion chamber, thereby allowing the combustion process to take place close to cool surfaces such as water jackets or coils.

Accordingly, it is an object of the present invention to provide an improved two-stage combustion chamber suitable for burning waste hydrocarbons such as crank case oil, spent motor oil, transmission fluid, lubrication dopes, and heavy bodied gear lubes.

It is another object of the present invention to provide an improved waste oil burner suitable for heating water or air while minimizing waste hydrocarbon condensation.

It is another object of the present invention to provide an improved waste oil burner suitable for heating water or air while minimizing waste hydrocarbon condensation, dripping, or other accumulation.

It is another object of the present invention to provide an improved combustion chamber that provides efficient combustion of waste hydrocarbons over a wide range of viscosities and purities.

It is another object of the present invention to provide for an improved heat transfer apparatus that allows a heat exchanger such as water coils or heat pipes with relatively cool surfaces, to be positioned close to the combustion flame of a combustion chamber, while still minimizing the potential for condensation of unburned fuel or combustion byproducts on such relatively cool surfaces of the heat exchanger.

It is a further object of the present invention to provide a combustion chamber which contains the flame within the hot chamber itself and minimizes droplet condensation, so that the combustion process may take place close to cool surfaces such as water jackets or coils.

Other features, objects and advantages of the present invention will become apparent upon reading the following specification when taken in conjunction with the drawings and the appended claims.

DETAILED DESCRIPTION OF THE DISCLOSED EMBODIMENTS

Figure 2:
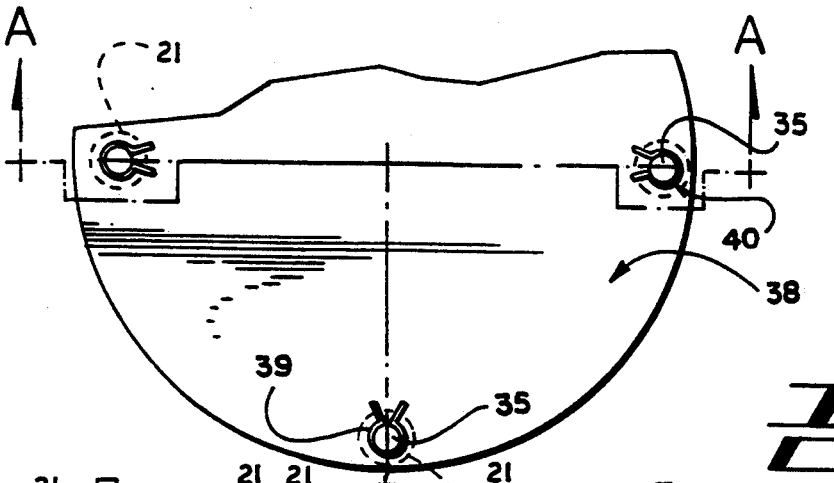
FIG. 2 is a top plan view of the preferred two-stage combustion chamber shown in FIG. 1.
Figure 1:
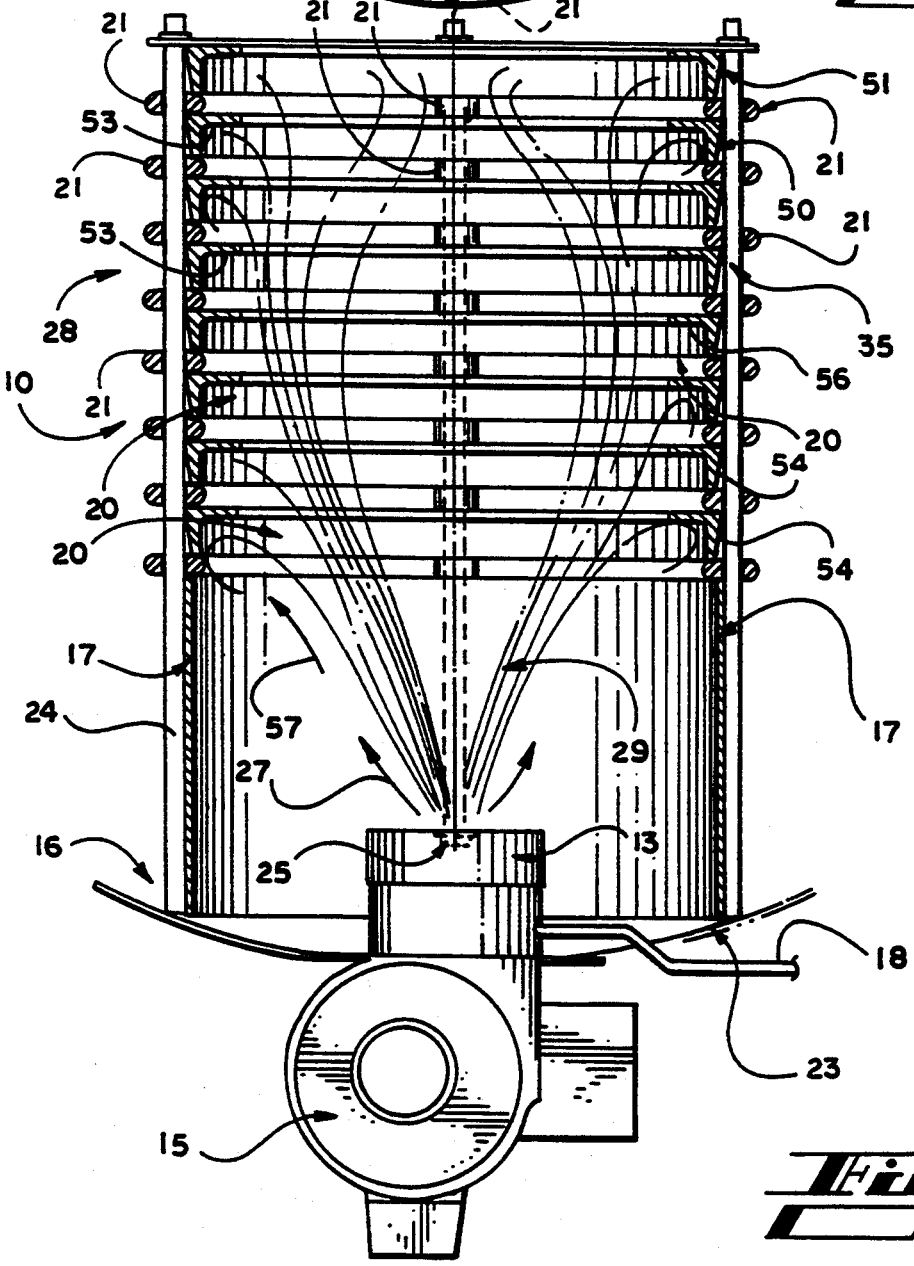
FIG. 1 is a cross sectional front elevational view of a two-stage combustion chamber constructed in accordance with the preferred embodiment of the present invention.

Referring now in more detail to the drawings, in which like numerals represent like parts throughout the several parts, FIG. 1 illustrates a two-stage combustion chamber 10 constructed in accordance with the preferred embodiment of the present invention. The preferred combustion chamber 10 has a generally elongated cylindrical body 17, with an oil burner 13 and an air blower 15 mounted at the center bottom of the combustion chamber. The preferred oil burner 13 preferably is a rotary atomizing oil burner such as the one illustrated in U.S. Pat. No. 4,504,215 to Akiyama et al., or a model CB90C oil burner manufactured by Clean Burn, Inc., of Leola, Pa. The details of the preferred oil burner are available in the literature supplied by the manufacturer. The fuel for the oil burner (e.g., waste hydrocarbons of varying viscosities) is provided to the burner 13 via a fuel line 18 which is connected to a fuel supply and pump (not shown).

The preferred air blower 15 is an electrically powered "squirrel cage" type air blower or the like, such as manufactured by Clean Burn, Inc., with an air flow rate of between about 15 and about 85 cubic feet per minute (CFM).

The air blower 15 and the oil burner 13 are preferably mounted to the bottom end 16 of the cylindrical body 17, oriented to direct a flame 29 generally upwardly and into the center of the cylinder of the combustion chamber. The combustion cylinder 17, air blower 15 and oil burner 13 are affixed to a fire wall 23, which separates the combustion chamber 10 from the fuel supply and the air blower, and thermally insulates the air blower from heat produced from combustion.

The preferred oil burner 13 includes, in its design, a rotary atomizer 25 for breaking the viscous hydrocarbons into smaller droplets. The air blower 15 forces air through the oil burner 13 in order to atomize the fuel and provide air for the combustion process. The rotary atomizer 25 spins and slings hydrocarbon droplets outwardly from the oil burner in the upward direction of the arrows 27. The droplets of hydrocarbon form a primary flame 29 as they burn, thus completing the first stage of combustion.

The combustion cylinder body 17 preferably comprises metal, ceramic, or other suitable material capable of withstanding high temperatures, in excess of 500° F. The cylinder 16 comprises a closed lower end 24 that contains the burner 13, and a slotted, partially open upper end 26 that surrounds and contains the flame 29 generated by the burner. A closed top cover or end plate 38 closes off the cylinder 17 and further confines the flame region 29 to the inside of the cylinder. The top cover 38 is also preferably fabricated from metal or other suitable high temperature material.

Four metal rods 35 are equally spaced around the combustion cylinder 17 in the preferred embodiment of the invention as a means of support. The rods are attached to the bottom 16 of the cylindrical chamber, and extend through holes 39 in the end plate 38. The end plate 38 is held in position with four retainer clips or pins 40, which firmly affix the end plate 38 in its position atop the rods 35.

The slotted upper end 28 of the cylinder 17 is formed with a plurality of spaced-apart annular rings 50 having an L-shaped cross section that are supported by the rods 35. The rings 50 form a superheated heat shield or baffle mechanism that contains the flame 29 but allow exhaust gases to escape from the combustion chamber. Each of the rings 50 has a thickness of about ⅛ inch, has an outer cylindrical flange or wall 53 about 1 inch high, an inner annular flange 54 about 1 inch wide, leaving an interior open diameter of about 10½ inches and an overall exterior diameter of about 12½ inches.

The L-section annular rings 50 are supported and separated by a plurality of annular or "doughnut" shaped spacers 21 such that open spaces 20 exist between the rings. The annular spacers 21 slip over each of the rods 35 so that alternating layers of an annular ring 50 and four spacers 21 can be laid upon the support rods to form the slotted upper end 28. Preferably, each of the spacers 21 is about ⅜ inch thick, to provide a separation of about ⅜ inch between rings 50.

The annular rings 50 are held in spaced-apart relation by the spacers 21 to allow heated gases from combustion to escape the chamber through the spaces 20. The rings 50 in use become superheated by the flame, and cause either (or both) the evaporation of any unburned fuel that impinges upon the rings and an ignition source for secondary combustion of unburned fuel and/or combustion byproducts. Preferably, the annular rings 50, although spaced apart, are positioned so that hydrocarbon droplets which are not burned in the primary flame 29 will impinge upon either the outer wall 53 or the inner flange 54 of the rings and create a secondary combustion. Thus, the size of the spacers 21 should be selected so that the spaces 20 are large enough to allow gases to escape without excess pressure build-up in the combustion chamber, yet small enough so that combustion byproducts and unburned fuel droplets tend to impinge upon a surface of the rings 50 rather than escape through the spaces.

It will also be observed from an inspection of FIG. 1 that the annular rings 50 are preferably arranged so that the outer flange or wall 53 depends downwardly relative to the burner 13, as opposed to the alternative arrangement wherein the outer flange or wall extends upwardly toward the top cover 38. In the preferred arrangement as illustrated in FIG. 1, there is no direct linear path for unburned fuel droplets from the burner 13 or combustion byproducts thrown off the flame 29 through one of the slotted openings 20. Rather, the inwardly extending annular flange 54 is positioned to "shield" each of the openings 20. The "shielding" of the openings 20 by the flanges 54 makes it extremely difficult for any unburned fuel droplets to escape from the combustion chamber 50.

Moreover, it will also be observed that the preferred annular rings 50 are constructed so that angular juncture or corner 56 between the inwardly extending annular flange 54 and the downwardly depending outer wall 53 is rounded. This rounded corner construction provides a downward deflection path for gases, combustion byproducts emitted by the flame, etc. that are intercepted by the flange 54. It will thus be appreciated that unburned particles or fuel droplets, or combustion byproducts, are turned back in to the flame and are more likely to be subjected to secondary combustion.

Those skilled in the art will understand that the spacing between rings 50, and indeed the dimensions of the rings, may vary from application to application. For example, the combustion chamber could be optimized to a particular range of fuel viscosities or other fuel properties by setting the dimensions of the overall cylinder diameter, flange 54 width, outer wall 54 height, and spacer 21 size.

It will be appreciated that the combination of the outer wall 54 and inner flange 54 of the rings 50 provide a substantially increased overall surface area for fuel evaporation and secondary combustion ignition over that in many prior art combustion chamber designs.

Those skilled in the art will understand that, over time, the annular rings 50 will oxidize or corrode as a result of exposure to elevated temperatures and corrosive combustion byproducts, and may require periodic replacement. It will therefore be appreciated that the stacked arrangement of alternating annular rings 50 and support spacers 21 allows fast and convenient replacement of the rings as they are consumed.

A cap 51, similar in shape and thickness to the L-shaped annular rings 50 except lacking the flange and therefore being closed, is preferably provided as the last or top element in the stack of rings 50. This cap 51 together with the end plate 38 close off the cylinder body 17 to prevent the escape of gases or unburned hydrocarbons through the top of the combustion chamber 10.

From the foregoing, it will be understood that the cylinder body 17 forms a baffle arrangement or flame containing means that surrounds and contains the primary flame 29 generated by the burner 13. It will be observed in FIG. 1 that the flame 29 generated by the burner has a "flame" shape, that is, a generally ovoid shape rotated about an axis, with a tapered "beginning" near the burner 13, a expanded "body", and a tapered "end" toward the top of the cylinder. In the preferred embodiment, the slotted upper end 28 begins (and the closed lower end 24 stops) at the point along the axis of the flame where the flame is approaching the widest. This would place the first of the the superheated rings 50 at a position generally along a line at a tangent to the flame, to intersect the expected trajectory 57 of any unburned fuel droplets ejected from the burner 13. It is believed that such an arrangement increases the likelihood that any combustion byproducts expelled from the outer "surface" of the flame 29 or any unburned fuel droplets will impinge upon a surface of one of the rings.

However, it should be understood that the shape of the combustion chamber 10 could be altered to vary the proportions of closed lower end 24 to slotted upper end 28, or to more closely conform the shape of the chamber to that of the flame itself, while still remaining within the present invention. For example, it is specifically contemplated that the slotted upper end 28 could begin at a point along the cylinder 17 lower along the cylinder, closer to the burner 13. Similarly, it is specifically contemplated that the rings 50 could be made of different diameters, starting with smaller diameter rings, with progressively increasing ring diameters, to a maximum ring diameter enclosing the "widest" portion of the flame 29, and then progressively decreasing ring diameters, to taper to a close at the top plate 38. Of course, such alternative arrangements would require a different support mechanism for the rings such as the use of discrete, unconnected spacers or a support mechanism outside of the combustion chamber.

Figure 3:
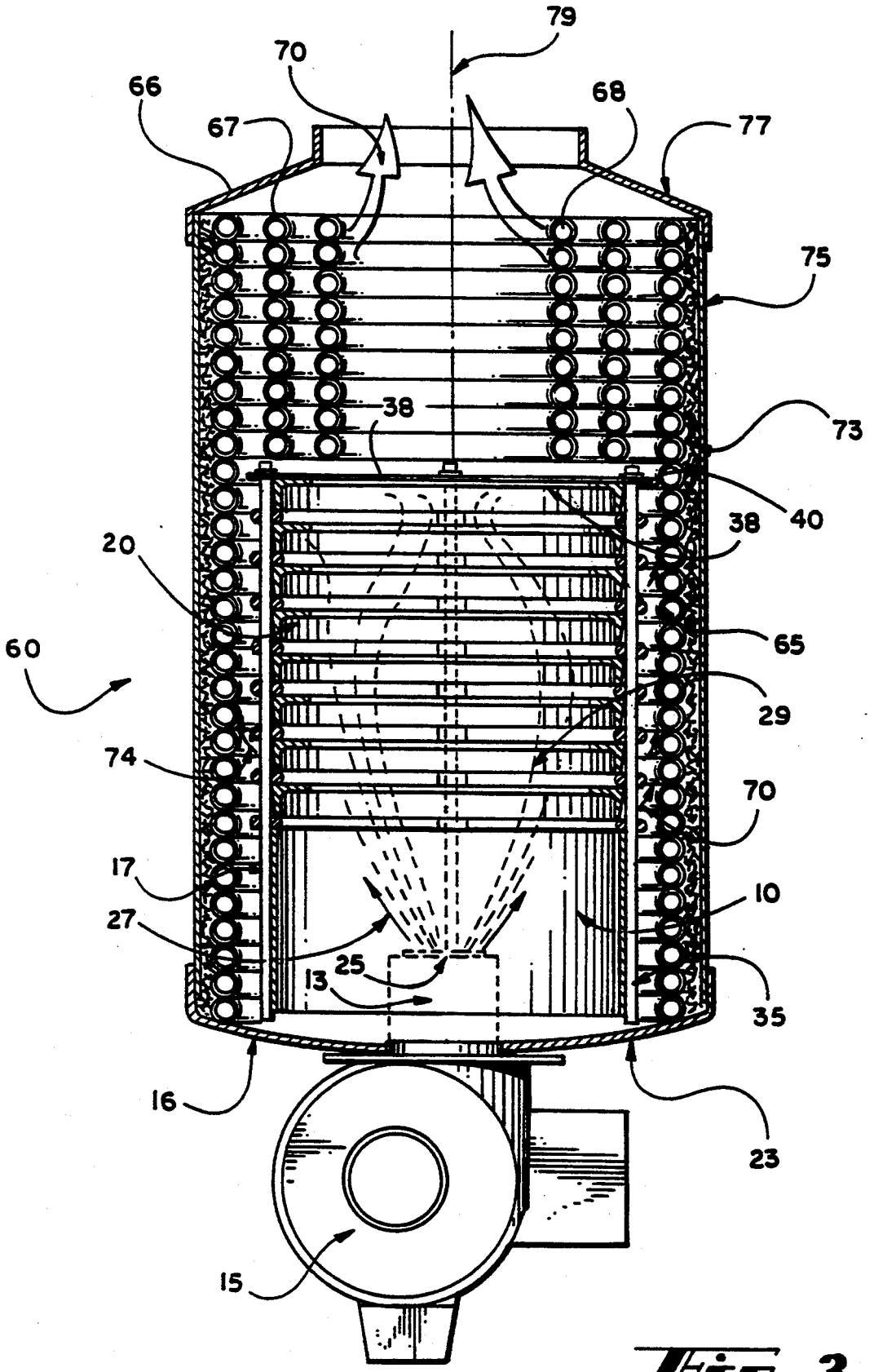
FIG. 3 is a cross sectional front elevational view of a coil-type water heater utilizing the preferred two-stage combustion chamber shown in FIG. 1.

With the construction of the preferred combustion chamber 10 now in mind, turn next to FIG. 3 for a discussion of the use of the combustion chamber as the primary heating element in a coil-type water heating unit 60. The combustion chamber 10 is housed within the confines of a plurality of spiral water coils 65 forming a heat exchanger. Preferably, the water coils are wound about the entire combustion chamber 10, starting near the bottom 16 of the combustion chamber, extending upwardly alongside but spaced apart from the combustion chamber a distance 74 sufficient to allow unimpeded flow of exhaust gases 70, to the top 66 of the water heater. An exhaust port 79 is provided in the top 66 to direct exhaust gases to a chimney or flue.

A second water coil 67 and third water coil 68, which may be connected with each other and/or with the water coils 65 to form a continuous water path, is preferably positioned over the top cover 38 of the combustion chamber in the path of heated exhaust gases 70 that are directed toward the exhaust port 70, for increased heat exchanger surface area.

Hot gases 70, created during the primary and secondary combustion process in the combustion chamber 10, escape from the combustion chamber 10 through the open spaces 20 created by spacers 21 located between the "L-shaped" annular rings 50. The hot gases 70 pass into the space 74 containing the spiral water coils 65 and heat the water contained in the water coils.

The spiral water coils 65 are preferably housed within an outer cylindrical shell or housing 75, and insulated by an insulating material 73 between the coils and the outer shell. The outer shell 75 surrounds the coils 65 and combustion chamber 10, and attaches at one end to the fire wall 23. The other end of the cylindrical shell is attached to an end dome cover 77 that includes the exhaust port 79 through which the exhaust gases 70 escape.

The hot gases 70 escape through the open spaces 20 between the L-shaped annular rings 50 in the combustion chamber 10, and heat the water circulating in the plurality of spiral water coils 65. Depending upon the capacity of oil burner 13 and the volume of water flowing through the spiral water coils 65, hot water or saturated steam may be produced.

Figure 4:
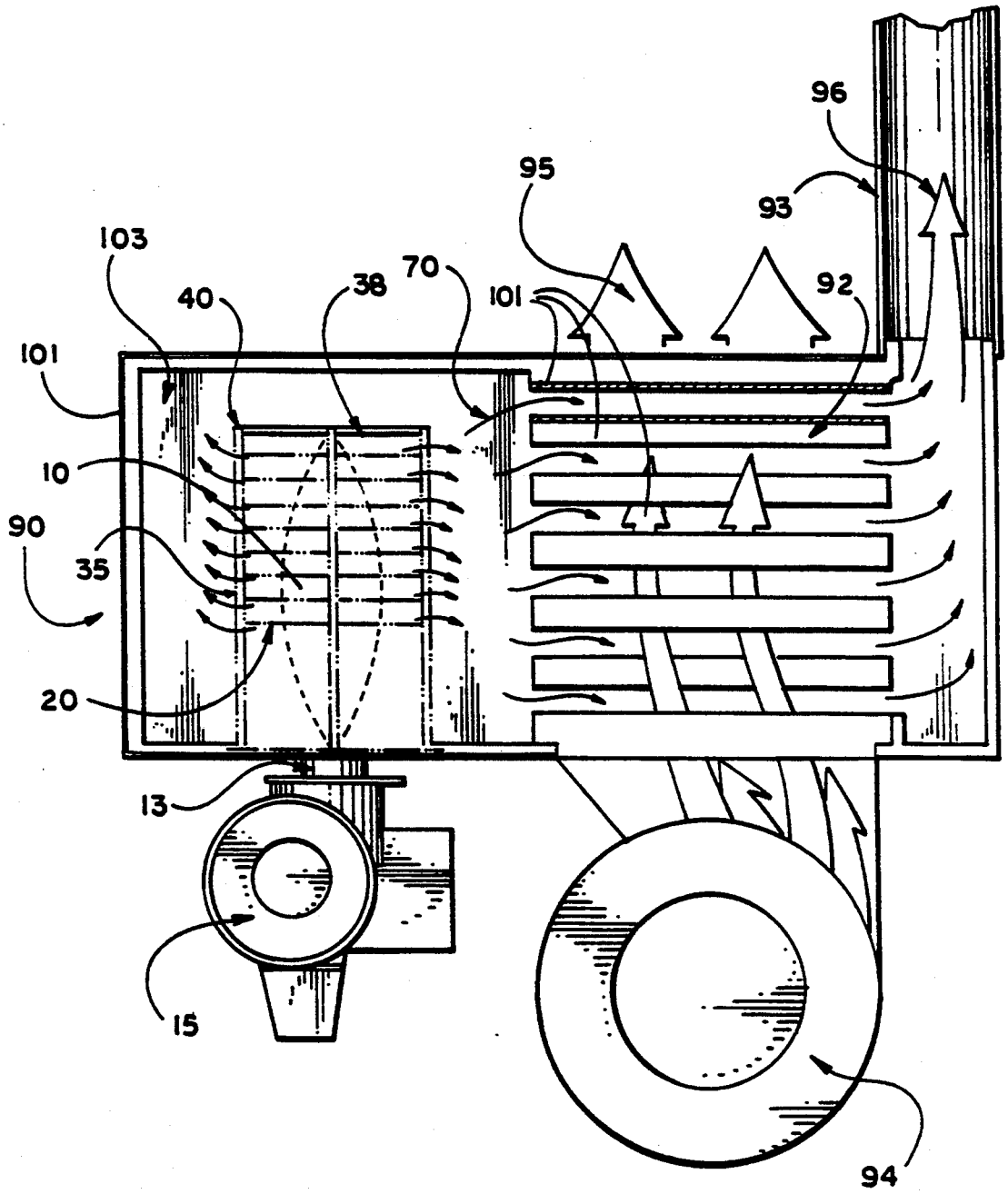
FIG. 4 is a cross sectional front elevational view of a hot air furnace utilizing the preferred two-stage combustion chamber shown in FIG. 1.

FIG. 4 illustrates the preferred combustion chamber 10 as employed as the primary heating unit in a hot air furnace 90. When used to heat air, the combustion chamber 10 is housed within a combustion chamber housing 101 surrounding and enclosing the combustion chamber in a space or plenum 103. A plurality of metal pipes 107 are connected to and extend from the plenum 103 through a heater exchanger 92 and into an exhaust flue 93. Air to be heated is forced through the heat exchanger 92 by a second air blower 94.

As in the case of the hot water heater embodiment, the hot gases 70 created during the primary and secondary combustion in the combustion chamber 10 escape from the combustion chamber 10 through the open spaces 20 created by the spacers 21 located between the L-shaped annual rings 50. The hot gases 70 then pass into the plenum. 103, and through the heat exchanger 92 via the pipes 107. The second air blower 94 forces unheated air through the heat exchanger 92, where it picks up heat from the hot gases. Warm air 95 is then forced from the heat exchanger 92 to supply heat to a destination such as a building or room. Spent and cooled gases 96 from the combustion processes in the combustion chamber 10 escape through the flue 93.

From the foregoing description, particular advantages of the present invention will be appreciated. Unlike rods, pins, or other devices in the flame pattern, the combustion chamber 10 completely surrounds the flame, effectively entrapping all stray droplets that could cause "smoking" and incomplete combustion.

Secondly, the combustion chamber with its L-section rings 50 deflects and redirects the flame and/or combustion gases. It is believed that the redirection of these gases forms a regenerative burning pattern that enhances the cleaner burning characteristics of the combustion chamber 10.

Thirdly, by containing the flame within a hot combustion chamber, droplet condensation is virtually eliminated. Therefore, the combustion process may take place close to cool surfaces such as water jackets or coils. This allows the waste oil burner to be utilized in a water or space heating application where the flame needs to be close to the water, to negate the insulating effects of the air space between the flame and the water coils or other cool surfaces. It will be understood that the outside temperature of the water coils 65 or heat exchanger pipes 107 does achieve a temperature much greater than that of the fluid or air circulating therein, generally appreciably below the 600°–800° temperature required for vaporization and/or secondary combustion of waste oil droplets and/or combustion byproducts. By providing the combustion chamber 10 as an envelope or flame containment means, oil droplets and combustion byproducts are trapped and vaporized inside the combustion chamber, preventing condensation that would otherwise take place on the cooler water or heat exchanger coils and result in incomplete combustion and collection of unburned oil.

Thus it is apparent that there has been provided, in accordance with the invention, a two-stage combustion chamber that fully satisfies the objects, aims and advantages set forth above. While the present invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An improved two-stage combustion chamber for combustible liquid fuels, having a replaceable flame containment housing, comprising:

a housing defining a generally cylindrical shape;

an oil burner for burning liquid fuel mounted in said housing to direct a flame in an axial direction of said generally cylindrical shape;

a plurality of spaced apart annular flame-containing rings comprising an outer wall operatively associated with an annular inner flange, said rings being generally coaxial with the flame produced by said oil burner, said annular rings being removable and replaceable, the outer walls of said annular rings defining outer boundaries of said generally cylindrical shape, the annular inner flanges of said annular rings defining inwardly extending planar surfaces for vaporization and/or secondary combustion of scattered oil droplets from said oil burner and combustion byproducts; and means for supporting said annular flame-containing rings in spaced apart relation.

2. The improved two-stage combustion chamber of claim 1, wherein said outer walls and said inner flanges of said annular rings define a juncture, and wherein said juncture is rounded to form a deflection surface.

3. The improved two-stage combustion chamber of claim 1, further comprising a top cover for closing off the top end of said generally cylindrical shape.

4. The improved two-stage combustion chamber of claim 1, wherein the diameter of each of said annular rings is the same.

5. The improved two-stage combustion chamber of claim 1, wherein said ring supporting means comprises a plurality of spaced apart elongate support rods positioned generally parallel to the axis of the flame of the oil burner, said support rods extending along and defining outer boundaries of said generally cylindrical shape.

6. The improved two-stage combustion chamber of claim 5, wherein said annular rings are confined between said support rods.

7. The improved two-stage combustion chamber of claim 5, wherein said ring supporting means further comprises:

a plurality of spacers slidably positionable over said support rods for supporting at least one of said annular rings in spaced apart relation between adjacent ones of said annular rings.

8. The improved two-stage combustion chamber of claim 7, wherein said spacers are annular doughnut shaped.

9. The improved two-stage combustion chamber of claim 7, wherein said annular rings are spaced apart a predetermined distance by said spacers, defining openings in said cylindrical surface between said annular rings, and wherein said annular rings are arranged so that the outer walls of said annular rings extend in the direction of said oil burner, wherein said oil burner is located at one end of said housing, and said inner flanges shield said openings between said annular rings.

10. The improved two-stage combustion chamber of claim 7, wherein said spacers are of a diameter and thickness sufficient to support the weight of a plurality of said annular rings in a stacked configuration.

11. The improved two-stage combustion chamber of claim 7, wherein each of said annular rings is supported on each of said rods by one of said spacers, and wherein said flame containment housing comprises a stack of alternating annular rings and spacers.

12. The improved two-stage combustion chamber of claim 1, wherein said oil burner comprises a rotary atomizing oil burner for dispersing oil-based fuel having a wide range of viscosities.

13. The improved two-stage combustion chamber of claim 1, further comprising an air blower for introducing air into said combustion chamber.

14. An improved two-stage combustion chamber for burning hydrocarbons, comprising:

a combustion chamber;

an oil burner mounted to said combustion chamber;

a plurality of support rods spaced around an inside wall of said combustion chamber and being parallel to said combustion chamber;

a plurality of annular rings having an L-shaped cross section having substantially the same diameter and being substantially parallel that are stacked within said support rods and separated by spacers defining open spaces between said annular rings; and a cap for closing off said combustion chamber and deflecting combustion byproducts out toward the circumference of the chamber.

15. The improved two-stage combustion chamber of claim 14, further comprising a metal end plate mechanically holding together the chamber and through which the rods pass; and a plurality of retainer pins for retaining said metal end plate on said rods.

16. The improved two-stage combustion chamber of claim 14, wherein said L-shaped annular rings comprise an outer wall and an inner flange, wherein said outer wall and said inner flange define a juncture, and wherein said juncture is rounded to form a deflection surface.

17. The improved two-stage combustion chamber of claim 14, wherein said spacers are slidably positionable over said support rods for supporting at least one of said annular rings in spaced apart relation between adjacent ones of said annular rings.

18. The improved two-stage combustion chamber of claim 17, wherein said spacers are annular doughnut shaped.

19. The improved two-stage combustion chamber of claim 14, wherein said annular rings are spaced apart a predetermined distance by said spacers, defining said open spaces between said annular rings.

20. The improved two-stage combustion chamber of claim 14, wherein said spacers are of a diameter and thickness sufficient to support the weight of a plurality of said annular rings in a stacked configuration.

21. The improved two-stage combustion chamber of claim 14, wherein each of said annular rings is supported on each of said rods by one of said spacers, and wherein a portion of said combustion chamber comprises a stack of alternating annular rings and spacers.

22. The improved two-stage combustion chamber of claim 14, wherein said oil burner comprises a rotary atomizing oil burner for dispersing oil-based fuel having a wide range of viscosities.

23. The improved two-stage combustion chamber of claim 14, further comprising an air blower for introducing air into said combustion chamber.

24. The improved two-stage combustion chamber of claim 14, wherein said annular rings comprise an outer wall and an inner flange, and wherein said annular rings are arranged so that the outer walls of said annular rings extend in the direction of said oil burner, wherein said oil burner is located at one end of said combustion chamber, and said inner flanges shield said openings between said annular rings.

25. A heat transfer apparatus for burning liquid hydrocarbons, comprising:

a combustion chamber, having a closed end, comprising a cylinder made of metal or other suitable material;

a liquid fuel oil burner mounted to the combustion chamber opposite said closed end for directing a flame inwardly of said combustion chamber;

an air blower for introducing air into said combustion chamber;

a plurality of spaced apart L-shaped annular rings positioned between said oil burner and said closed end, the interior of said annular rings defining the interior of said combustion chamber;

means for supporting said annular rings and said closed end in spaced apart relation; and heat exchanger means positioned around said combustion chamber for removing heat generated within said combustion chamber.

26. The heat transfer apparatus of claim 25, wherein said annular rings are removable and replaceable.

27. The heat transfer apparatus of claim 25, wherein said supporting means comprises a plurality of elongate rods defining an outer boundary of said cylinder, and a plurality of spacers, slidably positionable on said rods, for supporting said annular rings.

28. The heat transfer apparatus of claim 25, wherein each of said annular rings includes an outer wall and an inner flange, and wherein said annular rings are arranged so that the outer walls of said annular rings extend in the direction of said oil burner, wherein said oil burner is located at the end of said combustion opposite said closed end, and said inner flanges shield said openings between said annular rings.

29. The heat transfer apparatus of claim 25, wherein said apparatus is a water heater, and wherein said heat exchanger means comprises a plurality of spiral water coils positioned about said combustion chamber.

30. The heat transfer apparatus of claim 25, wherein said apparatus is a space heater, further comprising a plenum in which said combustion chamber is mounted for operation, and an air blower for moving air to be heated along an air path through said heat exchanger means, and wherein said heat exchanger means comprises a plurality of exhaust pipes extending from said plenum through said air path and into an exhaust flue.

31. An improved two-stage combustion chamber having a replaceable flame containment housing, comprising:

a housing defining a generally cylindrical shape;

an oil burner mounted in said housing to direct a flame in an axial direction of said generally cylindrical shape;

a plurality of spaced apart annular flame-containing tings comprising an outer wall operatively associated with an annular inner flange, said rings being generally coaxial with the flame produced by said oil burner, said annular rings being removable and replaceable, the outer walls of said annular rings defining outer boundaries of said generally cylindrical shape, the annular inner flanges of said annular rings defining inwardly existing surfaces for vaporization and/or secondary combustion of scattered oil droplets from said oil burner and combustion byproducts, said outer walls and said inner flanges of said annular rings defining a juncture, said juncture being rounded to form a deflection surface; and means for supporting said annular flame-containing rings in spaced apart relation.

32. An improved two stage combustion chamber having a replaceable flame containment housing, comprising:

a housing defining a generally cylindrical shape;

an oil burner mounted in said housing to direct a flame in an axial direction of said generally cylindrical shape;

a plurality of spaced apart annular flame-containing rings comprising an outer wall and an annular inner flange, said rings being generally coaxial with the flame produced by said oil burner, said annular rings being removable and replaceable, the outer walls of said annular rings defining outer boundaries of said generally cylindrical shape, the annular inner flanges of said annular rings defining inwardly extending surfaces for vaporization and/or secondary combustion of scattered oil droplets from said oil burner and combustion byproducts; and a plurality of spaced apart elongate support rods to support said annular flame-containing rings, said support rods being positioned generally to the axis of the flame of the oil burner and extending along and defining outer boundaries of said generally cylindrical shape.

33. The improved two-stage combustion chamber of claim 32, wherein said annular rings are confined between said support rods.

34. The improved two-stage combustion chamber of claim 32, further comprising:

a plurality of spacers slidably positionable over said support rods for supporting at least one of said annular rings in spaced apart relation between adjacent ones of said annular rings.

35. The improved two-stage combustion chamber of claim 34, wherein said spacers are annular doughnut shaped.

36. The improved two-stage combustion chamber of claim 34, wherein said annular rings are spaced apart a predetermined distance by said spacers, defining openings in said cylindrical surface between said annular rings, and wherein said annular rings are arranged so that the outer walls of said annular rings extend in the direction of said oil burner, wherein said oil burner is located at one end of said housing, and said inner flanges shield said openings between said annular rings.

37. The improved two-stage combustion chamber of claim 34, wherein said spacers are of a diameter and thickness sufficient to support the weight of a plurality of said annular rings in a stacked configuration.

38. The improved two-stage combustion chamber of claim 34, wherein each of said annular rings is supported on each of said rods by one of said spacers, and wherein said annular containment housing comprises a stack of alternating annular rings and spacers.

39. A heat transfer apparatus for burning hydrocarbons, comprising:

a combustion chamber, having a closed end, comprising a cylinder made of metal or other suitable material;

an oil burner mounted to the combustion chamber opposite said closed end for directing a flame inwardly of said combustion chamber;

an air blower for introducing air into said combustion chamber;

a plurality of spaced apart annular rings positioned between said oil burner and said closed end, the interior of said annular rings defining the interior of said combustion chamber;

a plurality of elongate rods, said rods defining an outer boundary of said cylinder, and a plurality of spacers, slidably positionable on said rods, for supporting said annular rings; and heat exchanger means positioned around said combustion chamber for removing heat generated within said combustion chamber.

* * * * *